US007678247B2

(12) United States Patent
Ribes Fernandez et al.

(10) Patent No.: US 7,678,247 B2
(45) Date of Patent: Mar. 16, 2010

(54) CATHODE EDGE SUPPORT DEVICE FOR A REMOTE IDENTIFIER IN ELECTRO-WINNING AND ELECTRO-REFINING PROCESS

(75) Inventors: Mauricio Ribes Fernandez, Santiago (CL); Hernan Conejeros Obreque, Santiago (CL); Alexander Cepeda Rojas, Santiago (CL)

(73) Assignee: 3M Innovative Properties Company, Saint Paul, MN (US)

( * ) Notice: Subject to any disclaimer, the term of this patent is extended or adjusted under 35 U.S.C. 154(b) by 978 days.

(21) Appl. No.: 10/577,139

(22) PCT Filed: Nov. 12, 2004

(86) PCT No.: PCT/US2004/037777

§ 371 (c)(1),
(2), (4) Date: Apr. 25, 2006

(87) PCT Pub. No.: WO2005/047569

PCT Pub. Date: May 26, 2005

(65) Prior Publication Data

US 2008/0023323 A1 Jan. 31, 2008

(30) Foreign Application Priority Data

Nov. 12, 2003 (CL) ..... 2335-03

(51) Int. Cl.
*C25D 1/04* (2006.01)

(52) U.S. Cl. ..... 204/281; 204/288; 204/279

(58) Field of Classification Search ..... 204/281, 204/288, 279
See application file for complete search history.

(56) References Cited

U.S. PATENT DOCUMENTS

| | | | | |
|---|---|---|---|---|
| 4,756,814 | A | 7/1988 | Van Voren et al. | |
| 6,104,291 | A * | 8/2000 | Beauvillier et al. | 340/572.1 |
| 6,312,573 | B1 * | 11/2001 | Dwyer et al. | 204/279 |
| 6,551,475 | B2 * | 4/2003 | Dwyer et al. | 204/281 |
| 6,610,183 | B2 * | 8/2003 | Knies | 204/281 |
| 6,746,581 | B2 * | 6/2004 | Ebert | 204/279 |
| 2002/0060629 | A1 | 5/2002 | Pfeiffer et al. | |
| 2004/0155778 | A1 * | 8/2004 | Shek et al. | 340/572.1 |
| 2004/0220602 | A1 * | 11/2004 | Deng et al. | 606/170 |

FOREIGN PATENT DOCUMENTS

| | | |
|---|---|---|
| DE | 10164366 | 6/2003 |
| NL | 6904021 | 7/1988 |
| WO | WO 02/07084 | 1/2002 |

* cited by examiner

*Primary Examiner*—Bruce F Bell
(74) *Attorney, Agent, or Firm*—Melissa E. Buss

(57) ABSTRACT

A device that supports a remote identifier for permanent cathodes in the electro-winning process. A preferred embodiment of the invention provides a support for a proximity identification device for permanent cathodes that, when interconnected with a remote system, provides for a record of its behavior and position in time of each cathode during its useful life in an electro-winning process.

6 Claims, 1 Drawing Sheet

CATHODE EDGE SUPPORT DEVICE FOR A REMOTE IDENTIFIER IN ELECTRO-WINNING AND ELECTRO-REFINING PROCESS

CROSS REFERENCE TO RELATED APPLICATIONS

This is a national stage filing under 35 U.S.C. 371 of PCT/US2004/037777 filed Nov. 12, 2004, which International Application was published by the International Bureau in English on May 26, 2005, which claims priority to Chilean Application No. 2335-03, filed Nov. 12, 2003.

TECHNICAL FIELD

The present invention relates to a device that supports a remote identifier for permanent cathodes in the electro-winning process. The present invention also relates to more particularly a support for a proximity identification device for permanent cathodes that, when interconnected with a remote system, provides for a record of its behavior and position in time of each cathode during its useful life in an electro-winning process.

BACKGROUND OF THE INVENTION

Today, the problem of identifying the condition of the permanent cathodes as a result of its operation, useful life and its time in the electro-winning process, remains unresolved. Typically, the maintenance, control and replacement of cathodes are technically carried out on a visual basis, which makes it difficult to exercise any preventive control action before a cathode fails due to extreme physical degradation.

Methods currently used to identify cathodes are associated with serial number engraving into the copper bar supporting the steel cathode. Special self-adhesive labels have also been used as well as bar codes in self-adhesive labels.

Although the use of bar codes in labels for steel cathodes has provided a good solution for this application in the past, the durability of the adhesive material and of the printing on the label presents problems due to the potential mechanical mistreatment, and specifically, the aggressiveness of the acid environment present in the electro-winning process. There is a need for an automatic identification system to be used in this process.

The engraving of a serial number in the hanger bar is the method most extensively used today for the identification of individual cathode plates. Although more resistant in the electro-winning environment, this method is not appropriate for the automatic identification of the cathode, and its durability is normally lower than the useful life of the plate itself, so it does not meet the need for identification of steel cathodes.

Different control systems have been tested for cathode operations, but none of them provides an effective solution to the identification problem. Consequently, there is the need to incorporate a device to carry or support an identification device that, linked to an ad-hoc system, provides the capability to remotely and readily control each cathode in an electro-winning operation. Thus, it is possible to guarantee the functionality of an electronic device that can be incorporated to the requested device and which useful life is longer than the useful life of the cathode.

DETAILED DESCRIPTION OF THE INVENTION

The proposed solution comprises a cathode identifying device support, installed in any edge of the cathode, preferentially in one of the vertical edges, which can incorporate an electronic identifier for the automatic identification of each cathode in an electro-winning process. The proposed supporting device allows for the incorporation of identification devices providing a high resistance to the acid environment of the process, such as the radio-frequency identification ("RFID") identification, which is an encapsulated electronic identification that can contains or reference, a trademark, serial number, installation date, operation number, etc. of a given cathode. This type of electronic identifier mounted on the invention device provides for the automatic recovery of the information for each cathode, does not require the assistance of an operator for the identification, is not affected by the acid environment, dust or paint on its surface, does not require intensive regular maintenance, and has high tolerance to the location within the cathode.

Figure 4:
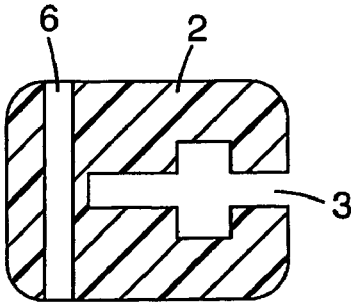
FIG. 4 is a cross-sectional view of the device of FIG. 3 taken along line 4-4.
Figure 5:
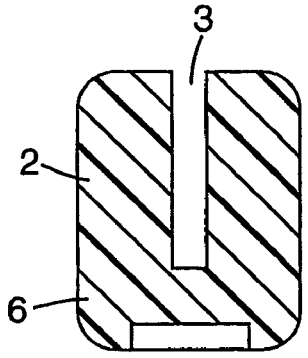
FIG. 5 is a cross-sectional view of the device of FIG. 2 taken along line 5-5.

The support device of the present invention preferably includes a longitudinal body (1) having a cross section (2) where there is an incision (3) that starts at the edge of the device and extends beyond the middle point of the cross section (2). This incision (3) can take different forms, depending on the type of cathode and the securing level required. FIG. 4 shows how this incision (3) can have perpendicular branches to allow the use of a removal tool to separate the device from the cathode (1). Alternatively, FIG. 5 shows a rectangular incision for another preferred embodiment of the invention.

Figure 1:
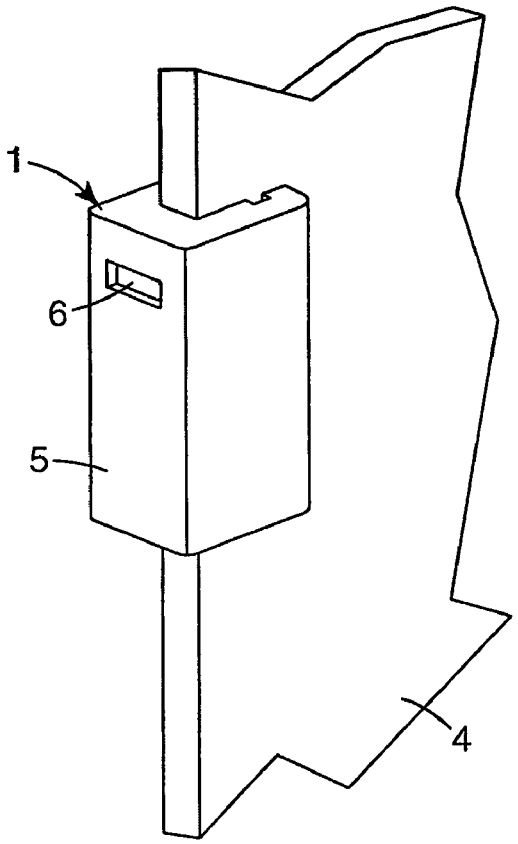
FIG. 1 is a perspective view of the device of the present invention installed on a cathode edge.
Figure 2:
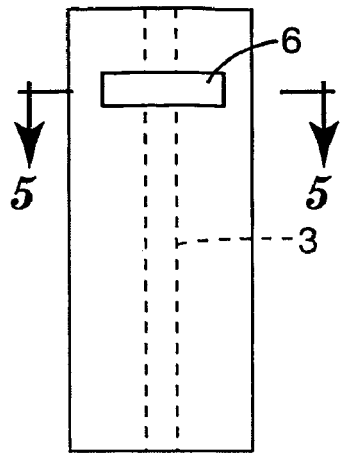
FIG. 2 is a backside view of the device of FIG. 1.

The incision (3) is designed to allow the support device (1) to be mounted in any of the edges of a steel cathode (4), as shown in FIG. 1. This fact allows that, depending on the circumstances or operating conditions of the cathode in the electro-winning process, the edge in which to install the device can be freely chosen. Nevertheless, tests have shown that the vertical edges of the cathode are the preferred location for the installation of the device (1).

Figure 3:
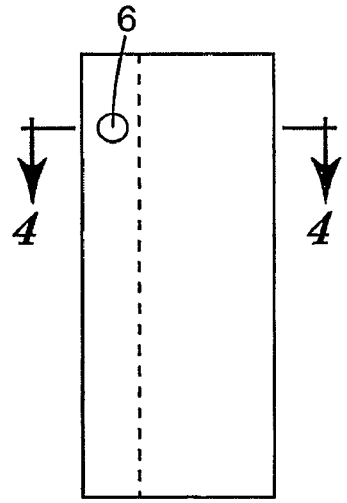
FIG. 3 is a side view of an alternative embodiment of the device of the present invention.

In the alternative embodiment of the present invention illustrated in FIG. 3, a hole (6) has been provided in the upper half (5) or back of the device (1), which is the end opposite the one where the incision has been located (3), to receive the electronic cathode identifier. This hole (6) has been designed to receive an RFID-type electronic element that can interact with a given remote system for the automatic identification of each cathode. This makes it possible to keep track of the location, permanency time, operation, and remaining useful life of each cathode, and therefore, take the due actions to avoid the damage and defective operation of a cathode as well as undesired interruptions of the electro-winning process.

Although not shown in the Figures, in one side of the device (1), a perforation is provided to take a pin forming a mechanical tie or securing element between the device and the permanent cathode to prevent such device from separating as a result of an action inherent of the electro-winning process.

The support device (1) is preferably made of a plastic-type polymer highly resistant to abrasion and corrosion, specifically that produced by the sulphuric acid inherent of an electro-winning process. Alternatively, other materials equally resistant that may be useful for the device manufacture.

The invention claimed is:

1. A support device for identification of permanent cathodes used in electro-winning processes, comprising: a longitudinal mass body including a cross-section having an incision that starts at a lower edge of the device and extends beyond a middle point of the cross-section, wherein the device further includes an upper edge that is opposite the incision, including a hole to receive an electronic cathode identifier that functions as an identifier for the device, and wherein the incision is designed for the support device to be mounted on any of the edges of a steel cathode.

2. A support device according to claim 1, wherein the incision is rectangular and includes perpendicular branches for the introduction of a removal tool.

3. A support device according to claim 1, wherein the incision is rectangular.

4. A support device according to claim 1, wherein the hole to receive an identifier is designed to receive an electronic RFID element.

5. A support device according to claim 1, wherein the device is made of a plastic-type polymer highly resistant to abrasion and corrosion.

6. A support device according to claim 1, wherein the device further includes a hole and a pin forming a mechanical tie or securing element between the device and the permanent cathode.

* * * * *